United States Patent [19]

Vetter et al.

[11] Patent Number: 5,021,331

[45] Date of Patent: Jun. 4, 1991

[54] COLOR PHOTOGRAPHIC RECORDING MATERIAL CONTAINING A DIR COUPLER

[75] Inventors: Hans Vetter, Cologne; Heinrich Odenwälder, Leverkusen; Peter Bergthaller, Gladbach; Thomas Krüger, Leverkusen, all of Fed. Rep. of Germany

[73] Assignee: Agfa Gevaert Aktiengesellschaft, Leverkusen, Fed. Rep. of Germany

[21] Appl. No.: 528,043

[22] Filed: May 23, 1990

[30] Foreign Application Priority Data

Jun. 6, 1989 [DE] Fed. Rep. of Germany ..... 3918394

[51] Int. Cl.[5] ..... G03C 7/32

[52] U.S. Cl. ..... 430/544; 430/957

[58] Field of Search ..... 430/544, 557, 957

[56] References Cited

U.S. PATENT DOCUMENTS

| | | | |
|---|---|---|---|
| 4,359,521 | 11/1982 | Fryberg et al. | 430/557 |
| 4,833,070 | 5/1989 | Kunitz et al. | 430/557 |
| 4,840,880 | 6/1989 | Ohlschlager et al. | 430/557 |
| 4,870,000 | 9/1989 | Bergthaller et al. | 430/557 |
| 4,897,341 | 1/1990 | Odenwalder et al. | 430/557 |

*Primary Examiner*—Richard L. Schilling
*Attorney, Agent, or Firm*—Connolly and Hutz

[57] ABSTRACT

Highly active silver halide development inhibitors are released from DIR couplers corresponding to formula I during color development. Where DIR couplers are used in color photographic silver halide materials, high edge effects and high inter-image effects are obtained.

$$A—(TIME)_n—Z \qquad \text{I}$$

In formula I,

A is the residue of a coupler which couples with the oxidation product of a silver halide developing agent under the conditions of photographic development and, in doing so, releases a group corresponding to the following formula $$—(TIME)_n—Z$$

TIME is a binding link which together with the group Z (a triazole ring) attached thereto is releases on reaction of the coupler with the oxidation product of a silver halide developing agent and which, in turn, releases the group Z with delay under the development conditions;

n is 0 or 1;

Z is a triazole ring corresponding to one of the following formulae $R^1$ is alkylthio;

$R^2$ is H, alkyl, alkythio, aryl or a heterocyclic group; at least one of the substituents $R^1$ and $R^2$ contains at a distance of 2 to 4 atoms from the triazole ring a group —CO—OR$^3$, —O—CO—OR$^3$ or —O—CO—R$^3$ hydrolyzable in aqueous alkali;

$R^3$ is alkyl, cycloalkyl or aryl.

1 Claim, No Drawings

COLOR PHOTOGRAPHIC RECORDING MATERIAL CONTAINING A DIR COUPLER

This invention relates to a color photographic recording material comprising at least one photosensitive silver halide emulsion layer containing a coupler which releases a development inhibitor during color development.

It is known that chromogenic development can be carried out in the presence of compounds which, during development, release diffusible substances in image relationship that are capable of exerting a certain effect, for example influencing the development of silver halide. If this effect is that further development is inhibited, compounds of the type in question are called DIR (development inhibitor releasing) compounds. The DIR compounds may be of the type which react with the oxidation product of a color developer to form a dye with elimination of an inhibitor group (DIR couplers) or of the type which release the inhibitor without at the same time forming a dye. Compounds of the latter type are also called DIR compounds in the narrower sense.

DIR couplers are known, for example, from U.S. Pat. No. 3,148, 062, U.S. Pat. No. 3,227,554, U.S. Pat. No. 3,615,506, U.S. Pat. No. 3,617,291 and DE-A No. 24 14 006.

The development inhibitors released are generally heterocyclic mercapto compounds or derivatives of benzotriazole. DIR couplers which release monocyclic triazoles as development inhibitor are described, for example, in DE-A No. 28 42 063 and in EP-A No. 0 272 573. DIR compounds which couple substantially without dye formation are described, for example, in U.S. Pat. No. 3,632,345, DE-A No. 23 59 295 and DE-A No. 25 40 959. A number of photographic effects influencing image quality can be obtained by using DIR compounds. Such effects include, for example, the reduction of gradation, the formation of a finer color grain, the improvement of definition by the so-called edge effect and the improvement of color purity and color brilliance by so-called interimage effects, cf. for example the Article entitled "Development-Inhibitor-Releasing (DIR) Couplers in Color Photography" by C.R. Barr, J. R. Thirtle and P. W. Vittum in Photographic Science and Engineering 13, 74 (1969).

DIR compounds which couple without dye formation have the advantage over DIR couplers which couple with dye formation that they can be universally used so that the same compound may be used in all photosensitive layers of a color photographic recording material irrespective of the color to be produced. By contrast, on account of the color produced from them, DIR couplers can generally only be used in some of the photosensitive layers unless the secondary color density attributable to them can be tolerated in the other layers. This advantage of DIR compounds is offset by the disadvantage that they are generally less reactive than DIR couplers. In practice, therefore, DIR couplers only are used, two or more different DIR couplers being used where necessary in the same recording material. Different DIR couplers may be associated with the differently spectrally sensitized layers according to the color produced from them.

It is normally important that the development inhibitor be rapidly released from the coupler during development because it is intended to influence the further course of the development process. Accordingly, it is highly desirable that the couplers in question show high activity. Particular importance is attributed in this regard to the leaving group attached to the coupling position of the coupler.

The problem addressed by the present invention is to provide a color photographic recording material containing couplers with a triazole ring attached to the coupling position, from which the triazole ring is released during development as a highly active silver halide development inhibitor.

The present invention relates to a color photographic recording material comprising at least one photosensitive silver halide emulsion layer and, associated therewith, a coupler bearing a releasable triazolyl group attached to its coupling position, characterized in that the coupler corresponds to formula I:

$$A—(TIME)_n—Z \qquad I$$

in which

A is the residue of a coupler which couples with the oxidation product of a silver halide developing agent under the conditions of photographic development and, in doing so, releases a group corresponding to the following formula $$—(Time)_n—Z$$

TIME is a binding link which together with the group Z (a triazole ring) attached thereto is released on reaction of the coupler with the oxidation product of a silver halide developing agent and which, in turn, releases the group Z with delay under the development conditions;

n is 0 or 1:

Z is a triazole ring corresponding to one of the following formulae

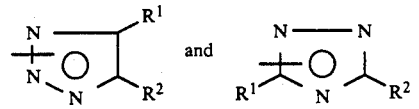

$R^1$ is alkylthio;

$R^2$ is H, alkyl, alkythio, aryl or a heterocyclic group;

at least one of the substituents $R^1$ and $R^2$ contains at a distance of 2 to 4 atoms from the triazole ring a group —CO—OR$^3$, —O—CO—OR$^3$ or —O—CO—R$^3$, hydrolyzable in aqueous alkali;

$R^3$is alkyl, cycloalkyl or aryl.

The residue of a coupler represented by A in formula I may be the residue of a coupler which produces a cyan, magenta or yellow dye during color development or even the residue of a coupler which produces substantially colorless or only faintly colored products. The coupler residues in question are essentially known coupler residues. Cyan couplers generally have a phenolic or naphtholic structure. Examples can be found, for example, in U.S. Pat. No. 2,369,929, U.S. Pat. No. 2,772,162, Ep-A No. 0 067 689, GB-A No. 519,208. Magenta couplers are derived from 5- pyrazolone, indazolone or various pyrazoloazoles. Examples can be found in DE-A No. 25 36 191, DE-A No. 27 03 589 and DE-A No. 28 13 522, GB-A No. 1,247,493.

Yellow couplers are derived, for example, from α-acyl acetanilides, such as pivaloyl acetanilides or benzoyl acetanilides or malonic dianilides. Examples can be found in U.S. Pat. No. 2,875,057, U.S. Pat. No. 3,265,506, U.S. Pat. No. 4,359,521 and DE-A No. 26 55 871. Couplers which produce substantially colorless products and, at the same time, release a photographically active compound are described, for example, in U.S. Pat. No. 3,632,345, U.S. Pat. No. 3,928,041, U.S. Pat. No. 3,958,993, U.S. Pat. No. 3,961,959, U.S. Pat. No. 4,052,213, U.S. Pat. No. 4,088,491.

A binding link represented by TIME in formula I is a group which, after release from the coupling position of the coupler during its coupling with the oxidation product of the silver halide developer, is capable of releasing a photographically active group attached thereto, in the present case a monocyclic triazole ring, in a following reaction. The group TIME is also called a timing group because, where a group such as this is present, a photographically active group attached thereto, for example an inhibitor group, is in many cases released and can become active with delay. Known timing groups include, for example, the group

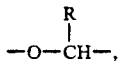

where the O atom is attached to the coupling position of the coupler while the C atom is attached to an N atom of a photographically active compound (for example DE-A No. 27 03 145), a group which undergoes an intramolecular nucleophilic displacement reaction after release from the coupler and, in the process, releases the photographically active compound (for example DE-A No. 28 55 697), a group in which, after release from the coupler, an electron transfer can take place along a conjugated system, resulting in release of the photographically active compound (for example DE-A No. 31 05 026) or the group

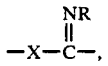

where X (for example —O—) is attached to the coupling position of the coupler and the C atom is attached to an atom of the photographically active compound and in which R represents aryl for example (for example EP-A No. 0 127 063).

The TIME group may be present or even completely absent (where n=0).

An alkylthio radical represented by $R^1$ or $R^2$ in formula I preferably contains 1 to 7 carbon atoms and may even be substituted, for example by one of the hydrolyzable groups mentioned.

An alkyl radical represented by $R^2$ or $R^3$ in formula I preferably contains 1 to 7 carbon atoms and may even be substituted, more especially by halogen, such as Cl or F, or by —CN.

A heterocyclic group ($R^2$) is, for example a furyl group.

An aryl radical represented by $R^3$ is, for example, phenyl optionally substituted, for example, by alkyl or halogen.

The 2 to 4 atoms which define the distance between the group —CO—$OR^3$, —O—CO—$OR^3$ or —O—CO—$R^3$ hydrolyzable in aqueous alkali and the triazole ring may be C atoms and/or hetero atoms. They may in turn contain a group —CO—O which, in this case, is hydrolyzable in aqueous alkali to a far lesser extent, if at all, cf INH-1.

The advantageous properties of the couplers according to the invention are presumably attributable inter alia to the fact that the triazole ring is evidently not only a good leaving group, so that the couplers are highly reactive, but evidently also has a certain tendency to be adsorbed onto the silver halide grain, thus inhibiting development of the silver halide.

The following are examples of suitable inhibitors:

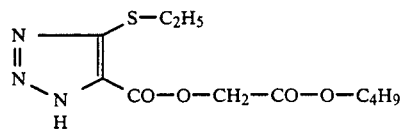

INH-1

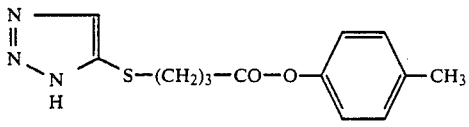

INH-2

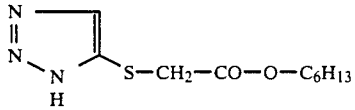

INH-3

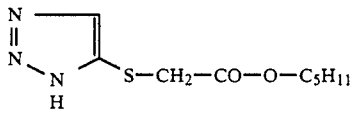

INH-4

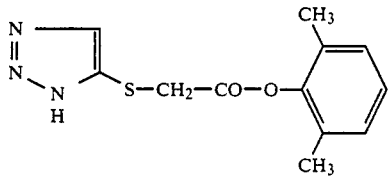

INH-5

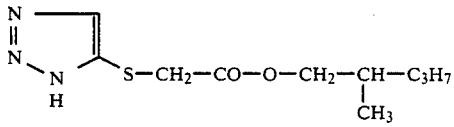

INH-6

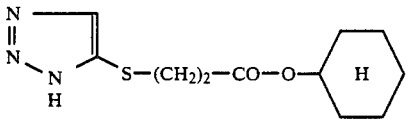

INH-7

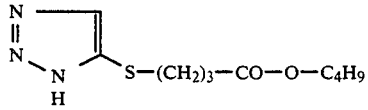

INH-8

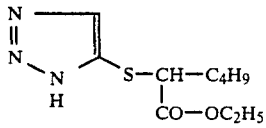

INH-9

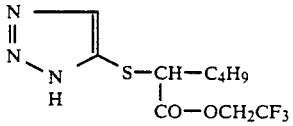

INH-10

-continued
INH-11
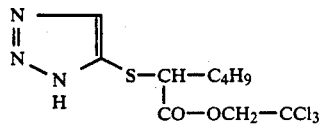
INH-12
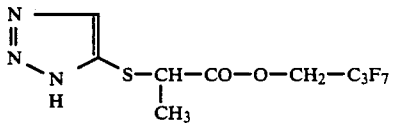
INH-13
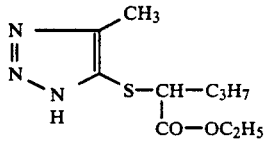
INH-14
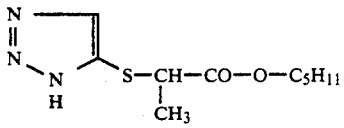
INH-15
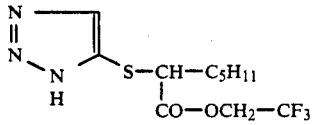
INH-16
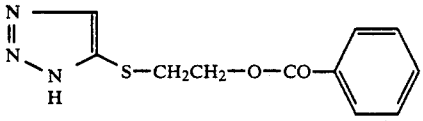
INH-17
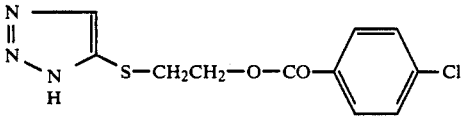
INH-18
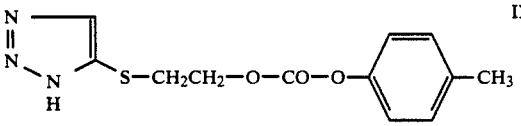
INH-19
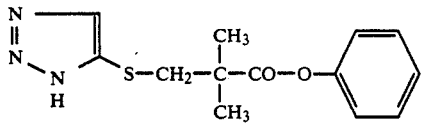
-continued
INH-20
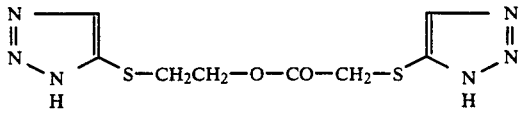
INH-21
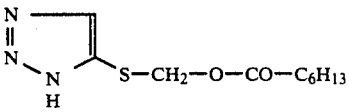
INH-22
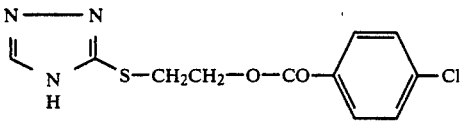
INH-23
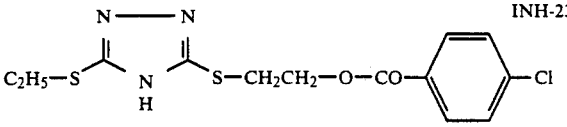
INH-24
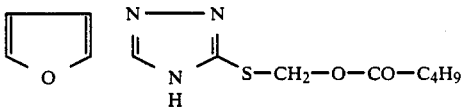
INH-25
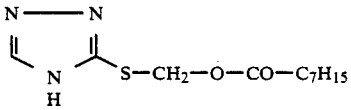
INH-26
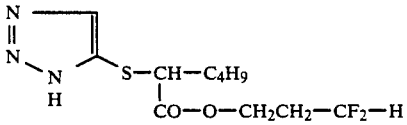
INH-27
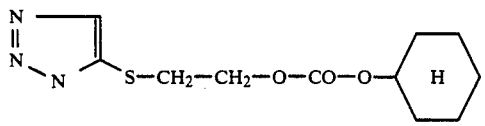
The following are examples of DIR couplers according to the invention:
DIR-1
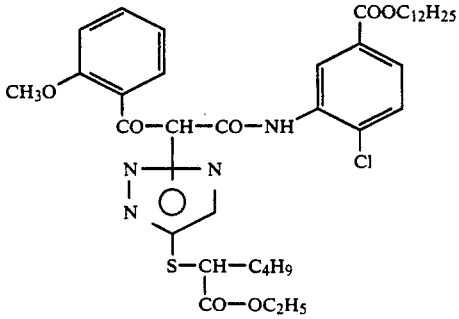

-continued
DIR-2
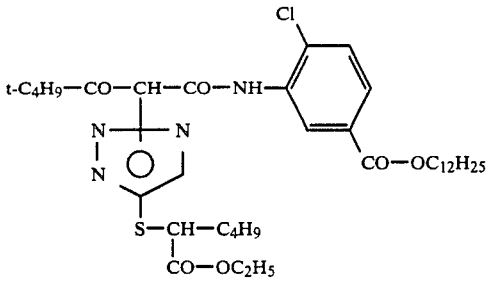
DIR-3
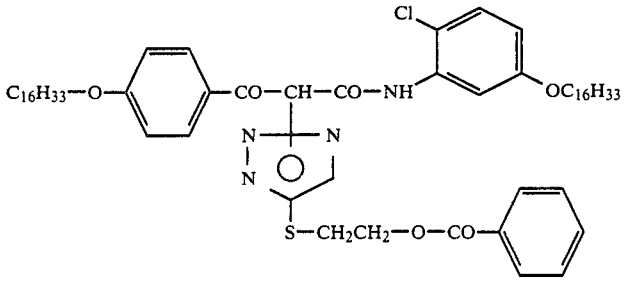
DIR-4
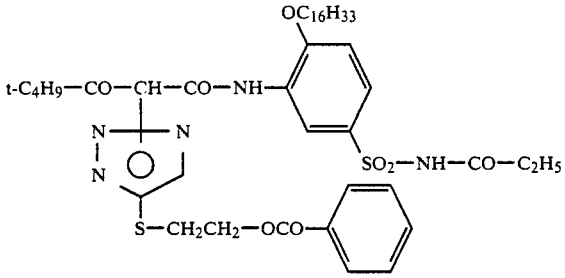
DIR-5
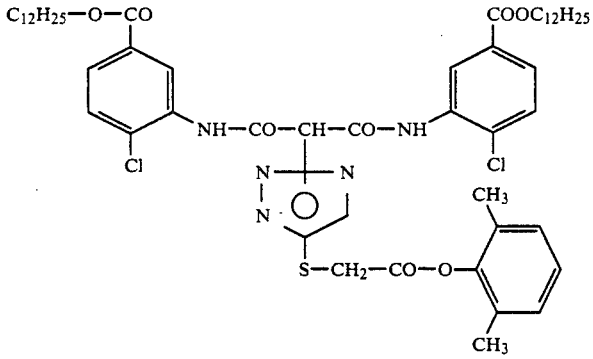
DIR-6
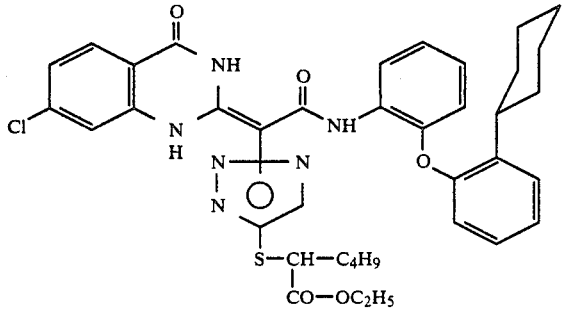

-continued
DIR-7
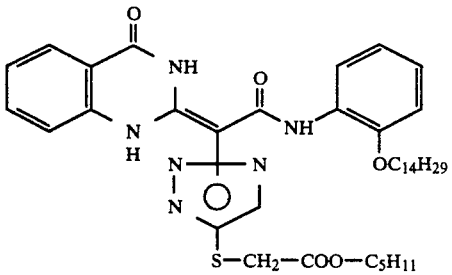
DIR-8
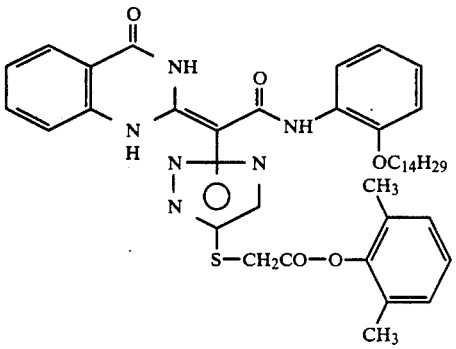
DIR-9
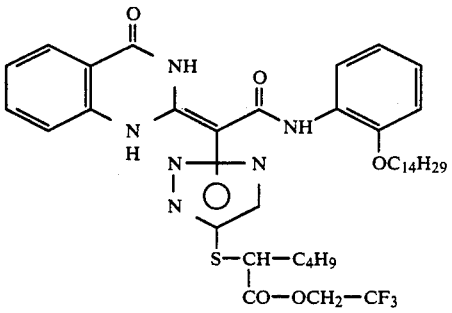
DIR-11
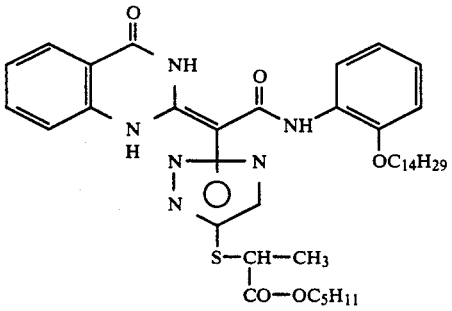
DIR-12
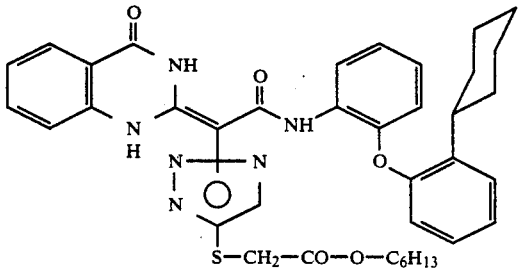

-continued
DIR-13
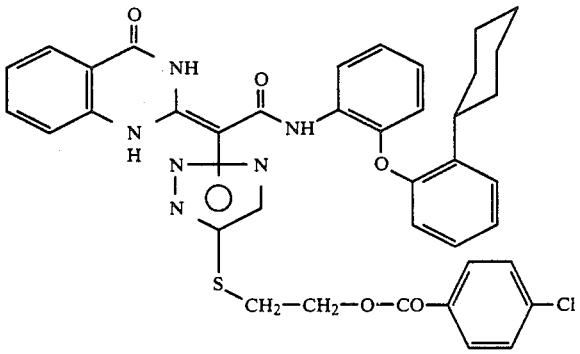
DIR-14
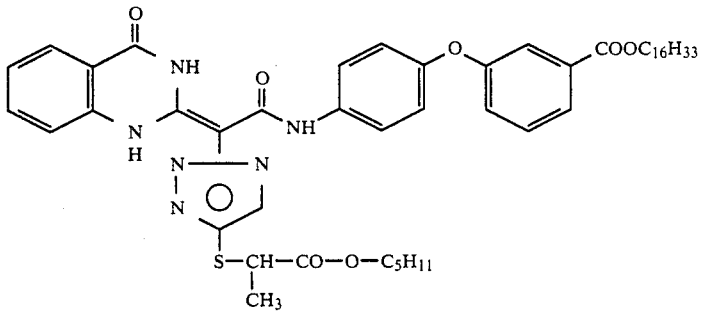
DIR-15
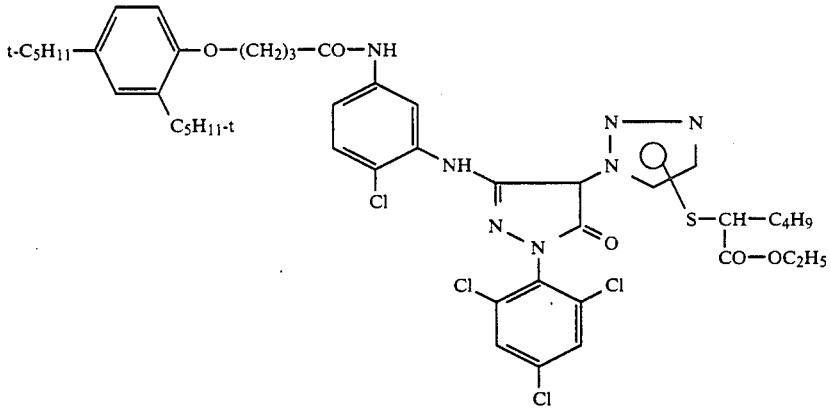
DIR-16
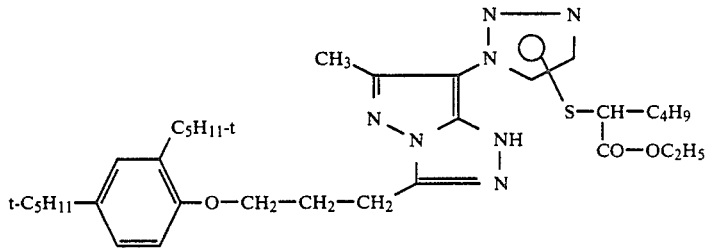

-continued
DIR-17
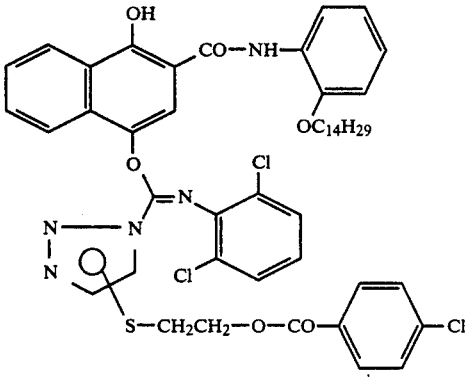
DIR-18
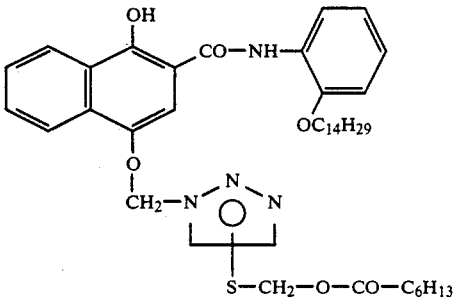
DIR-19
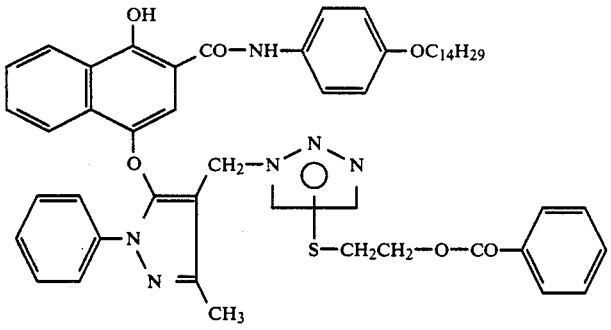
DIR-20
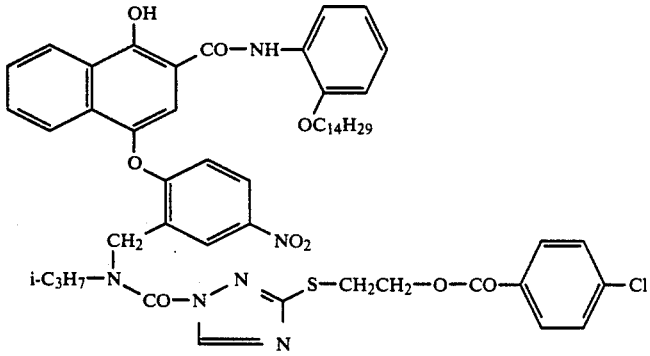

-continued

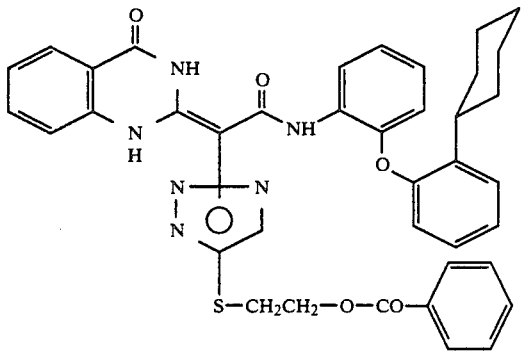

DIR-21

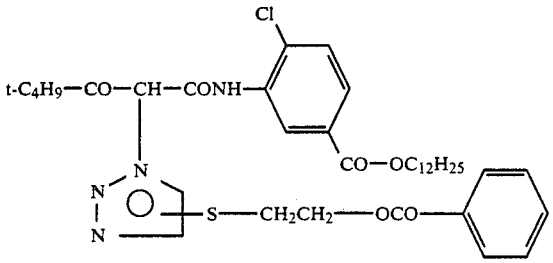

DIR-22

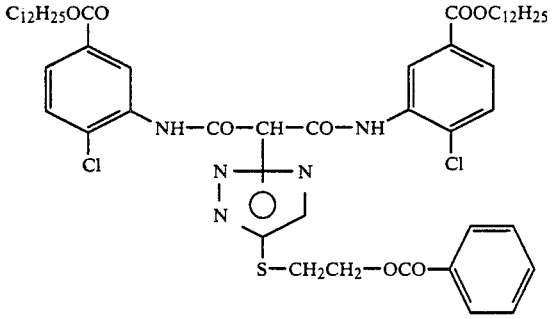

DIR-23

PREPARATION EXAMPLE 1

2-(1,2,3-triazolyl-4-thio)-caproic acid ethyl ester (inhibitor INH-9)

A solution of 12.5 g anhydrous Na salt of 4-mercapto-1,2,3-triazole in 100 ml ethanol is stirred overnight with 22 g 2-bromohexanoic acid ethyl ester. The sodium bromide precipitated is filtered off under suction and the residue is concentrated by evaporation in vacuo. Yield quantitative.

DIR coupler DIR-6

1st Step

2-Cyanoacetamido-2,-cyclohexyl diphenyl ether

A solution of 103 g dicyclohexyl carbodiimide in 200 ml dichloromethane is added dropwise at 30 to 40° C. to a solution of 45 g cyanoacetic acid (anhydrous) and 140 g 2-amino-2'-cyclohexyl diphenyl ether, prepared by reaction of 2-chloronitrobenzene with 2-cyclohexyl phenol potassium in dimethyl sulfoxide and subsequent hydrogenation, in 1,000 ml dichloromethane. After refluxing for 1 hour, the reaction mixture is cooled to 20.C and the dicyclohexyl urea precipitated is filtered off under suction. The filter residue is washed with 400 ml dichloromethane at 40° C., the combined filtrates are concentrated by evaporation and the residue is recrystallized from ethyl acetate. Yield: 240 g (72% of the theoretical amount, Mp.: 178 to 180° C.

2nd Step

3,4-dihydro-4-oxo-7-chloroquinazoline-2-acetic acid-2-(2-cyclohexyl)-phenoxyanilide After addition of 23 g ethanol, a suspension of 100 g 2-cyanoacetamido-2,-cyclohexyl diphenyl ether in 1,000 ml ethyl acetate is saturated with HCl gas at 0 to 2° C. After standing overnight, the reaction mixture is concentrated in a water jet vacuum at T<20° C. and filtered under suction after suspension with 500 g ethyl acetate.

The imino ether hydrochloride obtained is added in portions to a solution heated to 85° C. of 45 g 2-amino-4-chlorobenzamide in 300 ml propionic acid. The mixture is then kept at 100° C. for 1 hour, refluxed for 1 hour and then poured onto 1,500 g ice. After standing overnight, the supernatant liquid is decanted from the residue and stirred with methanol. 65 g of the compound crystallize out overnight. Mp. after drying: 184 to 186° C.

3rd Step

3,4-dihydro-4-oxo-7-chloroquinazoline-2-bromoacetic acid-2-(2-cyclohexyl)-phenoxyanilide 19.5 g (0.04 ml) of the compound obtained in step 2 in 200 ml acetic acid are brominated with 6.4 g bromine in 20 ml acetic acid at 25° C. After addition of 5 g sodium acetate, the reaction mixture is poured onto 400 ml ice and stirred until crystallization is complete. The product is filtered off under suction, digested with 100 ml methanol and refiltered under suction. Yield after drying: 17.5 g, Mp.: (decomp.) 160 to 170° C.

4th Step

DIR coupler DIR-6

9.8 g of the brominated coupler obtained and 5 g inhibitor INH-9 are stirred for one day at 25° C. in 100 ml ethyl acetate in the presence of 4 g potassium carbonate. The reaction mixture is introduced into 200 ml 5% acetic acid, the organic phase is separated off, washed with 50 ml water, dried with sodium sulfate and concentrated.

The product is purified by column chromatography on silica gel using toluene/ethyl acetate (8:2) as eluent. 5 g compound melting at 125 to 131° C. (two isomers!) are obtained.

PREPARATION EXAMPLE 2

1,2,3-triazolyl thioglycolic acid n-amyl ester (inhibitor INH-4)

16.45 g chloroacetic acid n-amyl ester are added dropwise at 25 to 30 C to a suspension of 12.5 g anhydrous monosodium salt of 5-mercapto-1,2,3-triazole in 60 ml dimethyl acetamide. After stirring for 1 hour at 40 to 60° C., the reaction mixture is introduced into 500 ml water, extracted with 50 ml toluene and the toluene phase concentrated after drying over sodium sulfate. Yield: 21 g (92% cf the theoretical amount of a pale yellowish oil.

DIR coupler DIR-7

6 g anhydrous powdered potassium carbonate are added with stirring to a suspension of a 11.4 g 2-(3,4-dihydro30 4-oxoquinazolinyl)-2-bromo-2'-tetradecyloxyacetanilide(the preparation of this compound is described in EP-A No. 0 287 833, page 23, see compound V-2 (brominated coupler)) and 7 g inhibitor INH-4 in 60 ml toluene. After stirring for 3 hours at 25° C. to 31° C., the reaction mixture is poured into 300 ml water, the emulsion is adjusted to pH 5 with acetic acid, the toluene phase is separated off, washed twice with 30 ml water, dried with sodium sulfate and concentrated by evaporation. 8 g of a faintly brown colored oil are obtained after stirring with acetonitrile.

The compounds according to the invention are suitable for use as DIR couplers in color photographic, more especially multilayer, recording materials. Where they are yellow couplers, they are preferably used in, or in association with, a photosensitive silver halide emulsion layer predominantly sensitive to the blue spectral region of visible light. The particular advantage of the couplers according to the invention, namely the comparatively low inhibition of development in the layer with which such a compound is associated in addition to the comparatively high inhibition of development in adjacent, non-associated layers, is of course particularly relevant in the case of a multilayer color photographic recording material which, in addition to a predominantly blue-sensitive silver halide emulsion layer, contains other photosensitive silver halide emulsion layers predominantly sensitive to the green or red spectral region of visible light. Correspondingly, the DIR couplers according to the invention, where they are magenta couplers, are preferably associated with a green-sensitive layer and, where they are cyan couplers, are preferably associated with a red-sensitive layer. Couplers which produce very little color during development may be associated as required with a blue-sensitive layer, a greensensitive layer or a red-sensitive layer or even with several of these layers without any danger of color falsification.

By virtue of their extremely high activity, the DIR couplers according to the invention may also be used in comparatively small quantities as color couplers to produce the desired effects, particularly the inter-image effects. For example, this enables a yellow DIR coupler according to the invention to be used not only in the blue-sensitive layers producing yellow dye, but also in other layers without an excessive, unwanted secondary density occurring in those layers. Accordingly, the DIR couplers according to the invention may also be advantageously used as yellow couplers in magenta layers and in cyan layers. The same also applies to the magenta couplers and the cyan couplers.

In the production of the photosensitive photographic recording material, the non-diffusing DIR couplers according to the invention may be incorporated in the casting solution of the silver halide emulsion layers or other colloid layers in known manner, optionally together with other couplers. For example, oil-soluble or hydrophobic couplers may be added to a hydrophilic colloid solution, preferably from a solution in a suitable coupler solvent (oil former), optionally in the presence of a wetting agent or dispersant. In addition to the binder, the hydrophilic casting solution may of course contain other typical additives. The solution of the coupler need not be directly dispersed in the casting solution for the silver halide emulsion layer or any other water-permeable layer; instead, it may advantageously first be dispersed in an aqueous nonphotosensitive solution of a hydrophilic colloid and the mixture obtained, optionally after removal of the lowboiling organic solvent used, may be mixed with the casting solution for the photosensitive silver halide emulsion layer or any other water-permeable layer before application.

Suitable photosensitive silver halide emulsions are emulsions of silver chloride, silver bromide or mixtures thereof, optionally with a small content of silver iodide of up to 15 mol-%, in one of the hydrophilic binders typically used. Gelatine is preferably used as binder for the photographic layers, although it may be completely or partly replaced by other natural or synthetic binders.

The emulsions may be chemically and spectrally sensitized in the usual way and the emulsion layers and other non-photosensitive layers may be hardened in the usual way with known hardeners.

Color photographic recording materials typically contain at least one silver halide emulsion layer for recording light of each of the three spectral regions red, green and blue. To this end, the photosensitive layers are spectrally sensitized in known manner by suitable sensitizing dyes. Blue-sensitive silver halide emulsion layers do not necessarily have to contain a spectral sensitizer because, in many cases, the natural sensitivity of the silver halide is sufficient for recording blue light.

Each of the photosensitive layers mentioned may consist of a single layer or, in known manner, for example as in the so-called double layer arrangement, may also comprise two or even more partial silver halide emulsion layers (DE-C No. 1 121 470). Normally, red-sensitive silver halide emulsion layers are arranged nearer the layer support than green-sensitive silver halide emulsion layers which in turn are arranged nearer than blue-sensitive emulsion layers, a non-photosensitive yellow filter layer generally being arranged between the green-sensitive layers and blue-sensitive layers. However, other arrangements are also possible. A non-photosensitive intermediate layer, which may contain agents to prevent the unwanted diffusion of developer oxidation products, is generally arranged between layers of different spectral sensitivity. Where several silver halide emulsion layers of the same spectral sensitivity are present, they may be arranged immediately adjacent to one another or in such a way that a photosensitive layer of different spectral sensitivity is present between them (DE-A No. 1 958 709, DE-A No. 25 30 645, DE-A No. 26 22 922).

Color photographic recording materials for the production of multicolor images normally contain dye-producing compounds, in the present case particularly color couplers, for producing the cyan, magenta and yellow dye images in spatial and spectral association with the silver halide emulsion layers of different spectral sensitivity.

In the context of the invention, spatial association means that the color coupler is present in such a spatial relationship to the silver halide emulsion layer that the two are capable of interacting in such a way as to allow imagewise accordance between the silver image formed during development and the dye image produced from the color coupler. This result is generally achieved by the fact that the color coupler is contained in the silver halide emulsion layer itself or in an adjacent, optionally nonphotosensitive binder layer.

By spectral association is meant that the spectral sensitivity of each of the photosensitive silver halide emulsion layers and the color of the component dye image produced from the particular spatially associated color coupler are in a certain relationship to one another, a component dye image relating to another color (generally for example the colors cyan, magenta or yellow in that order) being associated with each of the spectral sensitivities (red, green, blue).

One or more color couplers may be associated with each of the differently spectrally sensitized silver halide emulsion layers. Where several silver halide emulsion layers of the same spectral sensitivity are present, each of them may contain a color coupler, the color couplers in question not necessarily having to be the same. They are merely required to produce at least substantially the same color during color development, normally a color which is complementary to the color of the light to which the silver halide emulsion layers in question are predominantly sensitive.

In preferred embodiments, at least one non-diffusing color coupler for producing the cyan component dye image is associated with red-sensitive silver halide emulsion layers, at least one non-diffusion color coupler for producing the magenta component dye image is associated with green-sensitive silver halide emulsion layers and at least one non-diffusing color coupler for producing the yellow component due image is associated with blue-sensitive silver halide emulsion layers. However, other associations are also possible.

Color couplers for producing the cyan due image are generally couplers of the phenol or α-naphthol type, of which suitable examples are:

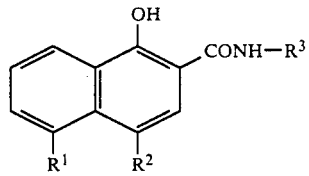

C-1: $R^1, R^2 = H; R^3 = -(CH_2)_3-O-$ 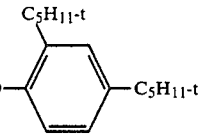 $-C_5H_{11}$-t

C-2: $R^1 = -NHCOOCH_2-CH(CH_3)_2; R^2 = H;$
$R^3 = -(CH_2)_3-OC_{12}H_{25}$

C-3: $R^1 = H; R^2 = -OCH_2-CH_2-SO_2CH_3; R^3 = -C_{16}H_{33}$

C-4: $R^1 = H; R^2 = -OCH_2-CONH-(CH_2)_2-OCH_3;$ $R^3 = -(CH_2)_4-O-$ 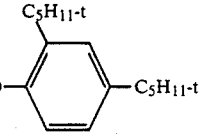 $-C_5H_{11}$-t C-5: $R^1, R^2 = H; R^3 = -(CH_2)_4-O-$ 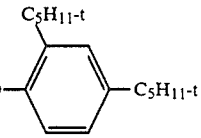 $-C_5H_{11}$-t -continued C-6: $R^1, R^2 = H; R^3 = -(CH_2)_4-O-$ 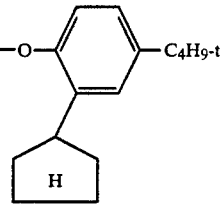 $-C_4H_9$-t C-7: $R^1 = H; R^2 = Cl; R^3 = -C(C_2H_5)_2-C_{21}H_{43}$
C-8: $R^1 = H; R^2 = -O-CH_2-CH_2-S-CH(COOH)-C_{12}H_{25}$
$R^3$ = Cyclohexyl

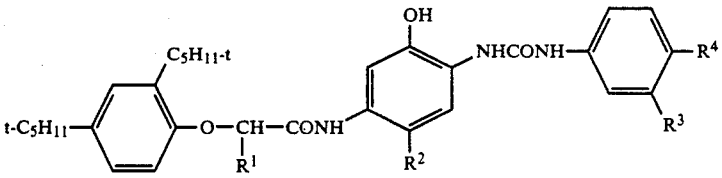

C-9: $R^1 = -C_4H_9; R^2 = H; R^3 = -CN; R^4 = Cl$
C-10: $R^1 = -C_4H_9; R^2 = H; R^3 = H; R^4 = -SO_2CHF_2$

C-11: $R^1 = -C_4H_9; R^2 = -O-$ 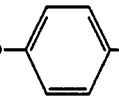 $-C(CH_3)_2-CH_2-C(CH_3)_3;$ $R^3 = H; R^4 = -CN$
C-12: $R^1 = C_2H_5; R^2, R^3 = H; R^4 = -SO_2CH_3$
C-13: $R^1 = -C_4H_9; R^2, R^3 = H; R^4 = -SO_2-C_4H_9$
C-14: $R^1 = -C_4H_9; R^2 = H; R^3 = -CN; R^4 = -CN$
C-15: $R^1 = -C_4H_9; R^2, R^3 = H; R^4 = -SO_2-CH_2-CHF_2$
C-16: $R^1 = -C_2H_5; R^2, R^3 = H; R^4 = -SO_2CH_2-CHF-C_3H_7$
C-17: $R^1 = -C_4H_9; R^2, R^3 = H; R^4 = F$
C-18: $R^1 = -C_4H_9; R^2, R^3 = H; R^4 = -SO_2CH_3$
C-19: $R^1 = -C_4H_9; R^2, R^3 = H; R^4 = -CN$

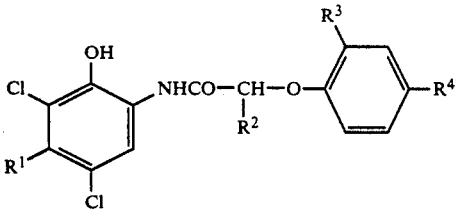

C-20: $R^1 = -CH_3; R^2 = -C_2H_5; R^3, R^4 = -C_5H_{11}$-t
C-21: $R^1 = -CH_3; R^2 = H; R^3, R^4 = -C_5H_{11}$-t
C-22: $R^1, R^2 = -C_2H_5; R^3, R^4 = -C_5H_{11}$-t
C-23: $R^1 = -C_2H_5; R^2 = -C_4H_9; R^3, R^4 = -C_5H_{11}$-t
C-24: $R^1 = -C_2H_5; R^2 = -C_4H_9; R^3, R^4 = C_4H_9$-t

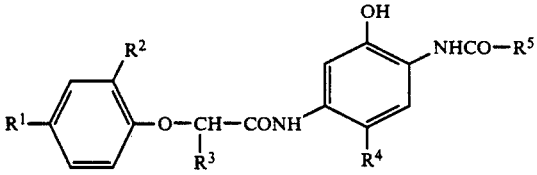

C-25: $R^1, R^2 = -C_5H_{11}$-t; $R^3 = -C_4H_9; R^4 = H; R^5 = -C_3F_7$
C-26: $R^1 = -NHSO_2-C_4H_9; R^2 = H; R^3 = -C_{12}H_{25}; R^4 = Cl;$
$R^5$ = phenyl
C-27: $R^1, R^2 = -C_5H_{11}$-t; $R^2 = Cl, R^3 = -C_3H_7$-i; $R^4 = Cl;$
$R^5$ pentafluorophenyl
C-28: $R^1 = -C_5H_{11}$-t; $R^2 = Cl; R^3 = -C_6H_{13}; R^4 = Cl;$
$R^5$ = -2-chlorophenyl Color couplers for producing the magenta dye image are generally couplers of the 5-pyrazolone, indazolone or pyrazoloazole type, of which suitable examples are:

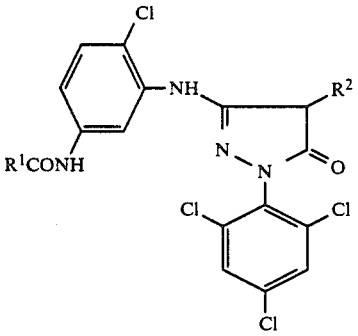
M-1: $R^1$ = 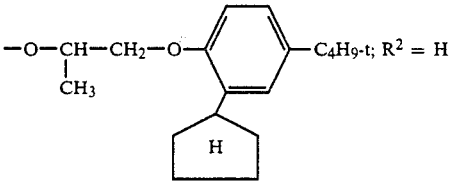 $C_4H_9$-t; $R^2$ = H
M-2: $R^1$ = 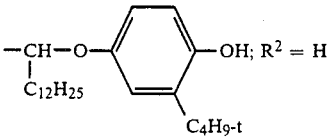 OH; $R^2$ = H
M-3: $R^1$ = $-C_{13}H_{27}$; $R^2$ = H
M-4: $R^1$ = $-OC_{16}H_{33}$; $R^2$ = H
M-5: $R^1$ = $-C_{13}H_{27}$; $R^2$ = 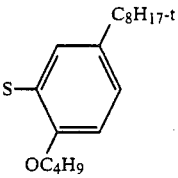
M-6: $R^1$ = 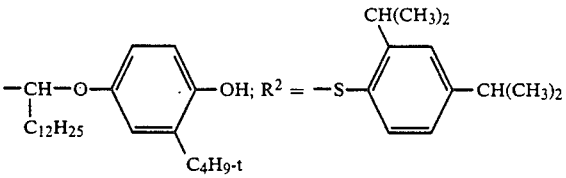
M-7: $R^1$ = $-C_9H_{19}$; $R^2$ = 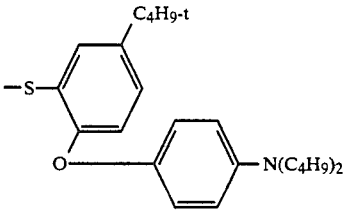
M-8: $R^1$ = 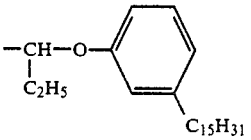 ; $R^2$ = 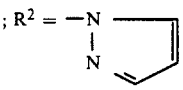

-continued
M-9: $C_{16}H_{33}$—NCO (CH3)
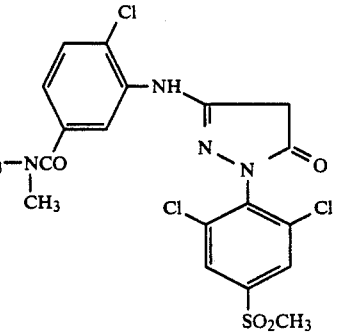
M-10: $C_8H_{17}$—CH=CH—$(CH_2)_8$
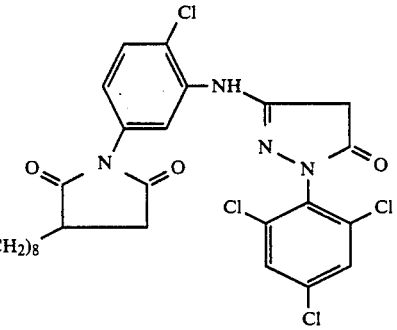
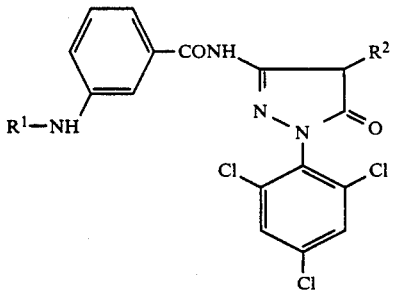
M-11: $R^1$ = —$SO_2$— 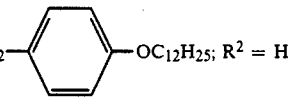 —$OC_{12}H_{25}$; $R^2$ = H
M-12: $R^1$ = —CO—$CH_2$—O— 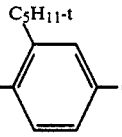 —$C_5H_{11}$-t; $R^2$ = H
M-13: $R^1$ = —CO—CH(—$C_2H_5$)—O— 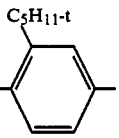 —$C_5H_{11}$-t; $R^2$ = H
M-14: $R^1$ = —CO—CH(—$C_2H_5$)—O— 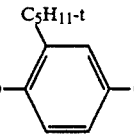 —$C_5H_{11}$-t;
$R^2$ = —O— 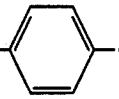 —$COOC_2H_5$ -continued
M-15: $C_{17}H_{35}CONH$
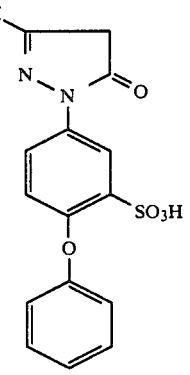
M-16: $C_{15}H_{31}$
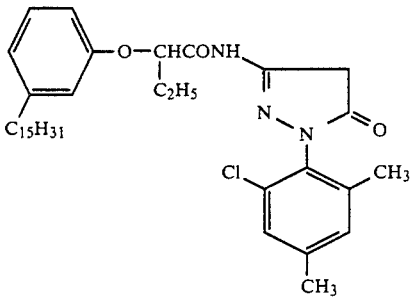
M-17: $t\text{-}C_4H_9CONH$
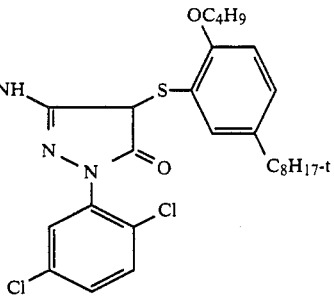
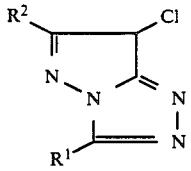
M-18: $R^1 = -(CH_2)_3$
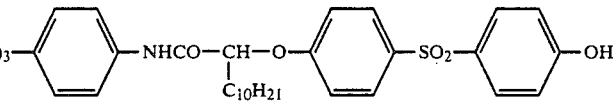
$R^2 = -CH_3$
M-19: $R^1 = -(CH_2)_3$
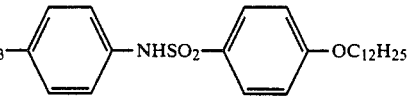
$R^2 = -CH_3$ -continued M-20: $R^1$ = 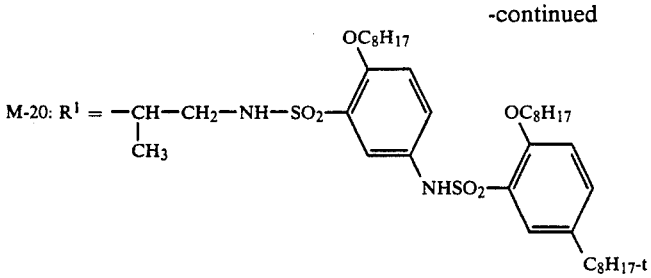

$R^2 = -C_4H_{9}$-t

M-21: $R^1$ = 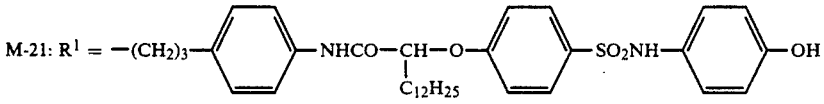

$R^2 = -CH_3$

M-22: 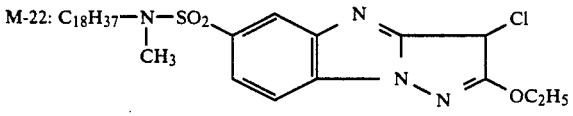

Color couplers for producing the yellow component dye image are generally couplers containing an open-chain ketomethylene group, more especially couplers of the α-acetyl acetamide type, of which suitable examples are α-benzoyl acetanilide couplers and α-pivaloyl acetanilide couplers corresponding to the following formulae:

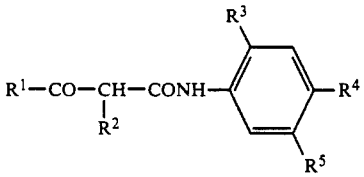

Y-1: $R^1 = -C_4H_{9}$-t;

$R^2$ = 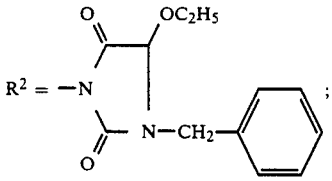 ; $R^3$ = Cl; $R^4$ = H;

$R^5$ = 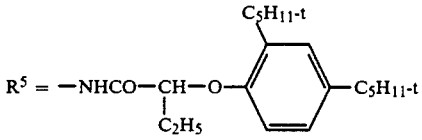

Y-2: $R^1 = -C_4H_{9}$-t;

$R^2$ = 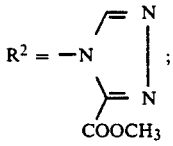 ; $R^3 = -OC_{16}H_{33}$; $R^4$ = H;

$R^5 = -SO_2NHCH_3$

Y-3: $R^1 = -C_4H_{9}$-t;

$R^2$ = 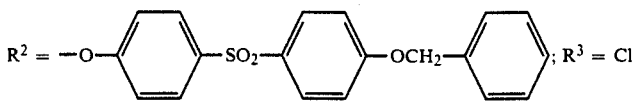 ; $R^3$ = Cl

-continued
$R^4$ = H; $R^5$ = —$NHSO_2$—$C_{16}H_{33}$
Y-4: $R^1$ = —$C_4H_9$-t;
$R^2$ = 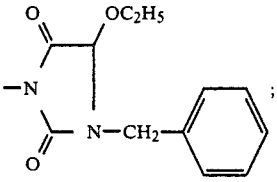 ; $R^3$ = Cl;
$R^4$ = H; $R^5$ = —$COOC_{12}H_{25}$
Y-5: $R^1$ = —$C_4H_9$-t;
$R^2$ = 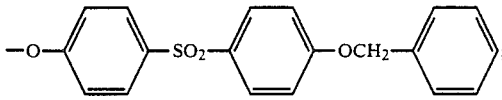 ; $R^3$ = Cl;
$R^4$ = H; $R^5$ = —$NHCO(CH_2)_3$—O— 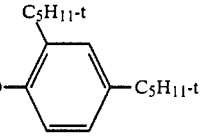 —$C_5H_{11}$-t
Y-6: $R^1$ = —$C_4H_9$-t;
$R^2$ = 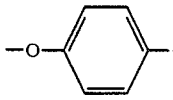 COOH; $R^3$ = Cl; $R^4$ = H;
$R^5$ = —$NHCO(CH_2)_3O$— 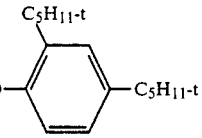 —$C_5H_{11}$-t
Y-7: $R^1$ = —$C_4H_9$-t;
$R^2$ = 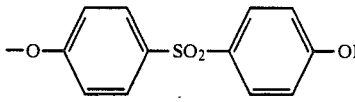 OH; $R^3$ = Cl;
$R^4$ = H; $R^5$ = —$NHSO_2$—$C_{16}H_{33}$
Y-8: $R^1$ = —$C_4H_9$-t;
$R^2$ = 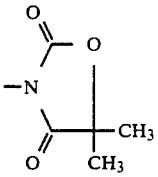 ; $R^3$ = Cl; $R^4$ = H;
$R^5$ = —NHCOCH(—$C_2H_5$)—O— 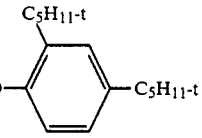 —$C_5H_{11}$-t
Y-9: $R^1$ = —$C_4H_9$-t;

-continued
$R^2$ = 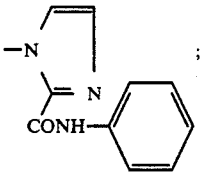 ; $R^3 = -OC_{16}H_{33}$;
$R^4$ = H; $R^5 = -SO_2NHCOC_2H_5$
Y-10: $R^1 = -C_4H_9$-t;
$R^2$ = 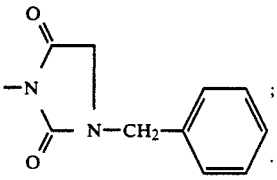 ; $R^3$ = Cl; $R^4$ = H
$R_3$ = 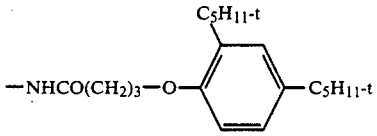
Y-11: $R^1 = -C_4H_9$-t;
$R^2$ = 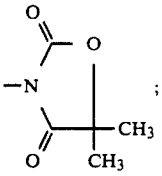 ; $R^3$ = Cl; $R^4$ = H;
$R^5 = -COOCH(C_4H_9)-COOC_{12}H_{25}$
Y-12: $R^1 = -C_4H_9$-t;
$R^2$ = 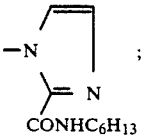 ; $R^3$ = Cl; $R^4$ = H;
$R^5$ = 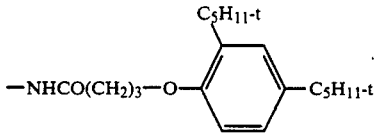
Y-13: $R^1 = -C_4H_9$-t;
$R^2$ = 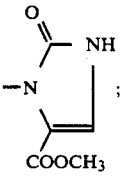 ; $R^3 = -OC_{16}H_{33}$; $R^4$ = H;
$R^5 = -SO_2NHCH_3$
$R^3$ = 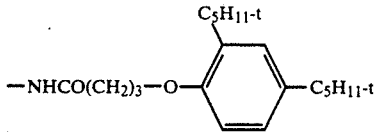

-continued
Y-14: $R^1 = -C_4H_9$-t;
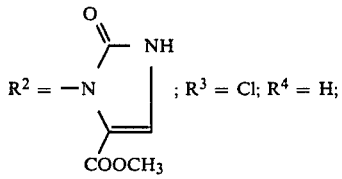
; $R^3$ = Cl; $R^4$ = H;
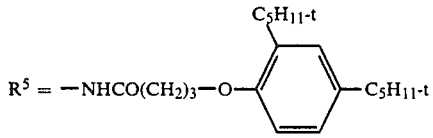
Y-15: $R^1$ = t-$C_5H_{11}$
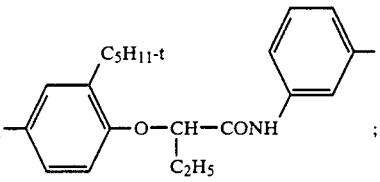
;
$R^2$, $R^4$, $R^5$ = H; $R^3 = -OCH_3$
Y-16: $R^1$ =
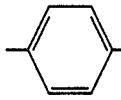
$-OC_{16}H_{33}$; $R^2$ =
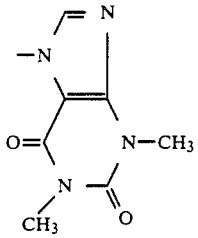
$R^3$, $R^5 = -OCH_3$; $R^4$ = H
Y-17: $R^1$ =
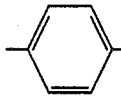
$-OCH_3$; $R^2$ =
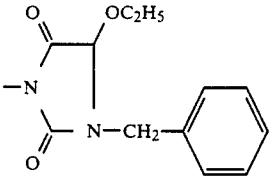
$R^3$ = Cl; $R^4$ = H; $R^5 = -COOC_{12}H_{25}$
Y-18: $R^1$ =
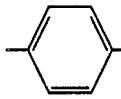
$-OC_{16}H_{33}$; $R^2$ =
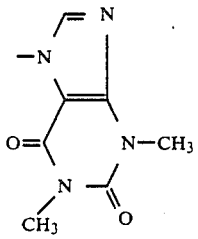
$R^3$ = Cl; $R^4$, $R^5 = -OCH_3$
Y-19: $R^1$ =
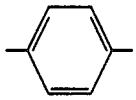
$-OC_{16}H_{33}$; $R^2$ =
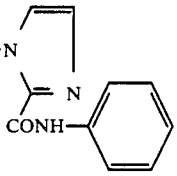
$R^3 = -OCH_3$; $R^4$ = H; $R^5 = -SO_2N(CH_3)_2$ -continued

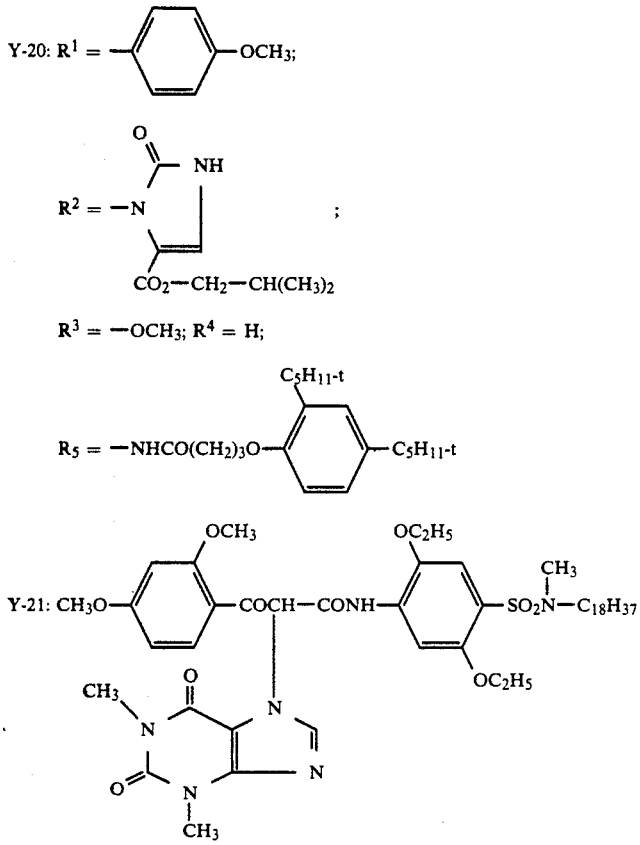

The color couplers may be 4-equivalent couplers and also 2-equivalent couplers. 2-Equivalent couplers are derived from 4-equivalent couplers in that they contain in the coupling position a substituent which is eliminated during the coupling reaction. 2-Equivalent couplers include those which are colorless and also those which have a strong color of their own that either disappears during the color coupling reaction or is replaced by the color of the image dye produced (mask couplers) and also white couplers which produce substantially colorless products on reaction with color developer oxidation products. 2-Equivalent couplers also include couplers which contain in the coupling position a releasable group which is released on reaction with color developer oxidation products and develops a certain desirable photographic activity, for example as a development inhibitor or accelerator, either directly or after one or more further groups have been released from the group initially released (cf. for example DE-A No. 27 03 145, DE-A No. 28 55 697, DE-A No. 31 05 026, DE-A No. 33 19 428). Examples of 2-equivalent couplers such as these are the known DIR couplers and also DAR and FAR couplers.

Since, in the case of DIR, DAR and FAR couplers, it is primarily the activity of the group released during the coupling reaction which is desirable, the dye-producing properties of these couplers being less important, it is also possible to use DIR, DAR and FAR couplers which produce substantially colorless products during the coupling reaction (DE-A No. 1 547 640).

The releasable group may also be a ballast group so that coupling products which are diffusible or which at least show weak or limited mobility are obtained during the reaction with color developer oxidation products (U.S. Pat. No. 4,420,556).

According to the invention, the color photographic recording material additionally contains at least one DIR coupler corresponding to formula I which may be arranged not only in the yellow layer, but also in the magenta layer and/or even in the cyan layer and even in a non-photosensitive layer adjacent to one of the layers mentioned.

In addition to the constituents mentioned above, the color photographic recording material according to the invention may contain other additives, such as for example antioxidants, dye stabilizers and agents for influencing the mechanical and electrostatic properties. In order to reduce or avoid the adverse effect of UV light on the dye images produced with the color photographic recording material according to the invention, it is of advantage for example to use UV absorbers in one or more of the layers present in the recording material, preferably in one of the upper layers. Suitable UV absorbers are described, for example, in U.S. Pat. No. 3,253,921, in DE-C-2 036 719 and in EP-A No. 0 057 160.

The usual layer supports may be used for the materials according to the invention, cf. Research Disclosure No. 17 643, Chapter XVII.

Suitable protective colloids or binders for the layers of the recording material are the usual hydrophilic film formers, for example proteins, particularly gelatin. Casting aids and plasticizers may be used, cf. the compounds mentioned in Research Disclosure No. 17 643, Chapters IX, XI and XII.

The layers of the photographic material may be hardened the usual way, for example with hardeners of the epoxide type, the heterocylic ethylene imine type and the acryloyl type. It is also possible to harden the layers by the process according to DE-A No. 22 18 009 to obtain color photographic materials suitable for high-temperature processing. The photographic layers may also be hardened with hardeners of the diazine, triazine or 1,2-dihydroquinoline series or with hardeners of the vinyl sulfone type. Other suitable hardeners are known from DE-A No. 24 39 551, DE-A No. 22 25 230, DE-A No. 23 17 672 and from the above-cited Research Disclosure 17 643. Chapter XI.

Other suitable additives can be found in Research Disclosure 17 643 and in "Product Licensing Index", December, 1971, pages 107–110.

To produce color photographic images, the color photographic recording material according to the invention is developed with a color developer compound. Suitable color developer compounds are any developer compounds which are capable of reacting with color couplers in the form of their oxidation product to form azomethine dyes. Suitable color developer compounds are aromatic compounds containing at least one primary amino group of the p-phenylenediamine type, for example N,N-dialkyl-p-phenylenediamines, such as N,N-diethyl-p-phenylenediamine, 1-(N-ethyl-N-methylsulfonamidoethyl)-3-methyl-p-phenylenediamine, 1-(N-ethyl-N-hydroxyethyl)-3-methyl-p-phenylenediamine and 1-(N-ethyl-N-methoxyethyl)-3-methyl-p-phenylenediamine.

Other useful color developers are described, for example, in J. Amer. Chem. Soc. 73, 3100 (1951) and in G. Haist, Modern Photographic Processing, 1979, John Wiley and Sons, New York, pages 545 et seq.

After color development, the material is bleached and fixed in the usual way. Bleaching and fixing may be carried out separately or even together with one another. Suitable bleaches are any of the usual compounds, for example $Fe^{3+}$ salts and $FE^{3+}$ complex salts, such as ferricyanides, dichromates, water-soluble cobalt complexes, etc. Particular preference is attributed to iron(III) complexes of aminopolycarboxylic acids, more especially for example ethylenediamine tetraacetic acid, N-hydroxyethyl ethylenediamine triacetic acid, alkyliminodicarboxylic acids and of corresponding phosphonic acids. Persulfates are also suitable bleaches.

EXAMPLE 1

A color photographic recording material for color negative development was prepared (layer combination 1 A—comparison) by application of the following layers in the order indicated to a transparent layer support of cellulose triacetate. The quantities are all based on 1 $m^2$. For the silver halide applied, the corresponding quantities of $AgNO_3$ are shown. All the silver halide emulsions were stabilized with 0.1 g 4-hydroxy-6-methyl-1,3,3a,7-tetraazaindene per 100 g $AgNO_3$.

Layer combination 1 A (comparison)

Layer 1 (anti-halo layer)

black colloidal silver sol containing
- 0.2 Ag
- 1.2 g gelatin
- 0.10 g UV absorber UV-1
- 0.20 g UV absorber UV-2
- 0.02 g tricresyl phosphate (TCP)
- 0.03 g dibutyl phthalate (DBP)

Layer 2 (micrate intermediate layer)

micrate silver bromide iodide emulsion (0.5 mol-% iodide; mean grain diameter 0.07 μm) of 0.25 $AgNO_3$ containing
- 1.0 g gelatin Layer 3 (red-sensitized layer, medium sensitivity)

red-sensitized silver bromide iodide emulsion (4.0 mol-% iodide; mean grain diameter 0.45 μm) of 5.35 g $AgNO_3$, containing
- 3.75 g gelatin
- 1.33 g cyan coupler C-19
- 0.05 g red mask RM-1
- 0.118 g DIR coupler DIR-A
- 1.33 g TCP
- 0.236 g DBP Layer 4 (intermediate layer)

of 1.43 g gelatin
- 0.74 g scavenger SC-1

Layer 5 (green-sensitized layer, medium sensitivity)

green-sensitized silver bromide iodide emulsion (4.0 mol-% iodide; mean grain diameter 0.45 μm) of 3.10 g $AgNO_3$ containing
- 2.33 g gelatin
- 0.775 g magenta coupler M-12
- 0.050 g yellow mask YM-1
- 0.068 g DIR coupler DIR-A
- 0.775 g TCP
- 0.136 g DBP Layer 6 (intermediate layer)

of 1.43 g gelatin
- 0.74 g scavenger SC-1

Layer 7 (yellow filter layer)

yellow colloidal silver sol containing
- 0.09 g Ag
- 0.34 g gelatin

Layer 8 (blue-sensitive layer, medium sensitivity)

blue-sensitized silver bromide iodide emulsion (4.0 mol-% iodide; mean grain diameter 0.45 μm) of 3.46 g $AgNO_3$ containing
- 1.73 g gelatin
- 1.25 g yellow coupler Y-20
- 0.076 g DIR coupler DIR-A
- 1.25 g TCP
- 0.152 g DBP Layer 9 (intermediate layer)

of 1.43 g gelatin
- 0.74 g scavenger SC-1

Layer 10 (protective and hardening layer)

of 0.68 g gelatin
- 0.73 g hardener (CAS Reg. No. 65411-60-1)
- 0.50 g formaldehyde scavenger FF In addition to the couplers already mentioned, the following compounds are used in Example 1:

UV absorber UV-1
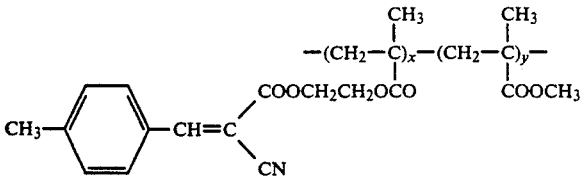
ratio by weight x:y = 7:3
UV absorber UV-2
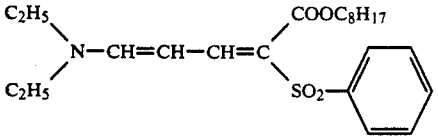
Red mask RM-1
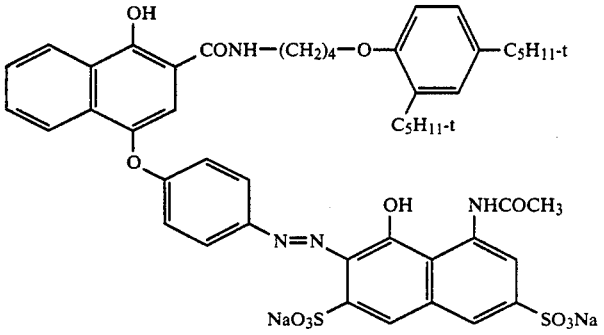
Yellow mask YM-1
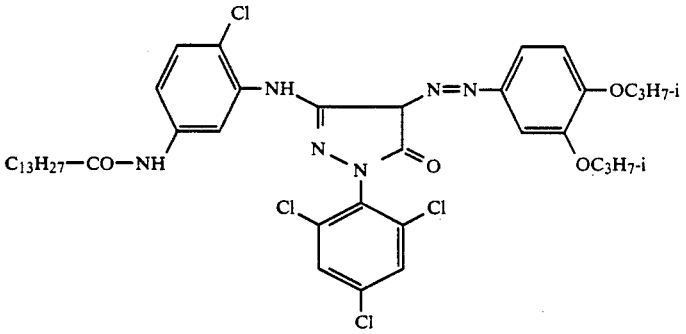
Scavenger SC-1
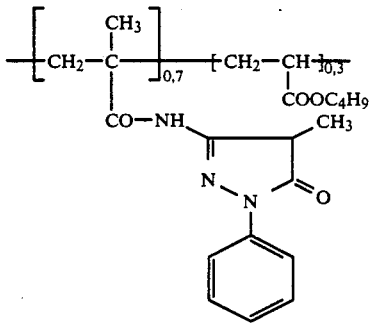
Formaldehyde scavenger FF
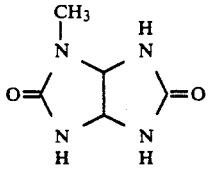

Na perfluorobutane sulfonate is used as wetting agent in all the layers. DIR coupler used in layer combination 1A:

DIR-A

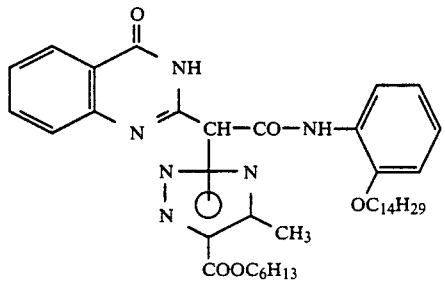

(DIR coupler D-1 from EP-A-0 287 833)

Other layer combinations 1B to 1F were produced in the same way, differing from layer combination 1A only in the DIR coupler used in an equivalent quantity in layers 3, 5 and 8.

Development was carried out after exposure of a grey wedge, as described in "The British Journal of Photography", 1974, pages 597 and 598.

The results after processing are shown in Table 1. The inter-image effects IIE are calculated as follows:

$$IIE_{cy} = \frac{\gamma_{red} - \gamma_w}{\gamma_w};$$

$$IIE_{mg} = \frac{\gamma_{green} - \gamma_w}{\gamma_w}$$

where $\gamma$red is the gradation on selective exposure with red light;

$\gamma$green is the gradation on selective exposure with green light;

i$\gamma$w is the gradation on exposure with white light.

The edge effect EE shown in Table 1 is the difference between the microdensity and macrodensity for a macrodensity of 1, as described in James, The Theory of the Photographic Process, 4th Edition, Macmillan Publishing Co., Inc. 1977, page 611. In Table 1:

$EE_{cy}$ is the EE in the red-sensitiZed layer $EE_{mg}$ is the EE in the green-sensitized layer

TABLE 1

| Layer combination | DIR coupler | $IIE_{mg}$ | $IIE_{cy}$ | $EE_{mg}$ | $EE_{cy}$ |
|---|---|---|---|---|---|
| 1A | DIR-A | 37 | 40 | 0.49 | 0.62 |

TABLE 1-continued

| Layer combination | DIR coupler | $IIE_{mg}$ | $IIE_{cy}$ | $EE_{mg}$ | $EE_{cy}$ |
|---|---|---|---|---|---|
| 1B | DIR-6 | 75 | 45 | 0.80 | 1.15 |
| 1C | DIR-12 | 76 | 65 | (1) | (1) |
| 1D | DIR-21 | 76 | 49 | 0.80 | 0.85 |
| 1E | DIR-22 | 63 | 35 | 0.63 | 0.58 |
| 1F | DIR-23 | 133 | 62 | (1) | (1) |

(1) value above the measurement limit

We claim:

1. A color photographic recording material comprising at least one photosensitive silver halide emulsion layer and, associated therewith, a coupler bearing a releasable triazolyl group attached to its coupling position, characterized in that the coupler corresponds to formula I:

$$A—(TIME)_n—Z \qquad I$$

in which

A is the residue of a coupler which couples with the oxidation product of a silver halide developing agent under the conditions of photographic development and, in doing so, releases a group corresponding to the following formula $$—(TIME)_n—Z$$

TIME is a binding link which together with the group Z (a triazole ring) attached thereto is released on reaction of the coupler with the oxidation product of a silver halide developing agent and which, in turn, releases the group Z with delay under the development conditions;

n is 0 or 1;

Z is a triazole ring corresponding to the following formula

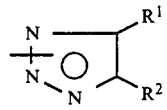

$R^1$ is alkylthio;

$R^2$ is H, alkyl, alkylthio, aryl or a heterocyclic group; at least one of the substituents $R^1$ and $R^2$ contains at a distance of 2 to 4 atoms from the triazole ring a group —CO—OR$^3$, —O—CO—OR$^3$ or —O—CO—R$^3$ hydrolyzable in aqueous alkali;

$R^3$ is alkyl, cycloalkyl or aryl.

* * * * *